US006574938B1

(12) United States Patent
Francesco et al.

(10) Patent No.: US 6,574,938 B1
(45) Date of Patent: Jun. 10, 2003

(54) CONSTRUCTIONAL SANDWICH PANEL FOR HIGH STRENGTH WALL AND COVERING ASSEMBLIES, AND METHOD FOR MAKING SAID PANEL

(76) Inventors: Donati Francesco, Via A. Manzoni, 19, 24060, S. Paolo D'Argon (Bergamo) (IT); Donati Giuseppe, Via A. Manzoni, 19, 24060, S. Paolo D'Argon (Bergamo) (IT); Oberti Pierrosario, Via A. Manzoni, 19, 24060, S. Paolo D'Argon (Bergamo) (IT)

( * ) Notice: Subject to any disclaimer, the term of this patent is extended or adjusted under 35 U.S.C. 154(b) by 0 days.

(21) Appl. No.: 09/232,309

(22) Filed: Jan. 15, 1999

(30) Foreign Application Priority Data

Feb. 25, 1998 (IT) ..... MI98A0371

(51) Int. Cl.[7] ..... E04B 1/14

(52) U.S. Cl. ..... 52/745.19; 52/783.11; 52/783.17; 52/783.18; 52/783.19; 52/746.1; 264/167; 264/286; 264/288

(58) Field of Search ..... 52/783.1, 783.11, 52/783.17, 783.18, 783.19, 745.19, 746.1; 156/472, 473, 470, 471, 65, 582, 196, 199, 210; 264/165, 167, 285, 286, 288

(56) References Cited

U.S. PATENT DOCUMENTS 4,429,012 A * 1/1984 Danko ..... 428/12
4,530,197 A * 7/1985 Rainville ..... 52/797
4,897,146 A * 1/1990 Inzinna ..... 156/462
4,916,027 A * 4/1990 Delmundo ..... 428/586
4,935,082 A * 6/1990 Bennett et al. ..... 156/205
5,007,225 A * 4/1991 Teasdale ..... 52/799
5,069,737 A * 12/1991 Guiton ..... 156/210
5,393,588 A * 2/1995 Weddendorf ..... 428/175
5,508,083 A * 4/1996 Chapman, Jr. ..... 428/167
5,543,204 A * 8/1996 Ray ..... 428/179
5,609,942 A * 3/1997 Ray ..... 428/182
5,628,865 A * 5/1997 Marschke ..... 156/473
5,766,410 A * 6/1998 Wu ..... 156/472
5,792,552 A * 8/1998 Langkamp et al. ..... 428/309.9
5,951,816 A * 9/1999 Marschke ..... 156/472
6,067,764 A * 5/2000 Johansen ..... 52/302.1
6,080,495 A * 6/2000 Wright ..... 428/623

* cited by examiner

*Primary Examiner*—Carl D. Friedman
*Assistant Examiner*—Yvonne M. Horton
(74) *Attorney, Agent, or Firm*—Hedman & Costigan, P.C.

(57) ABSTRACT

A sandwich panel for high strength wall and covering assemblies, comprising at least a plate element and at least a fretted element, glued to the plate element, the fretted element comprising a sheet metal plate having a size substantially like that of the plate element and a cross-section having a profile including a plurality of adjoining integral trapezium shape elements each defining a top and a bottom flat portion.

1 Claim, 11 Drawing Sheets

CONSTRUCTIONAL SANDWICH PANEL FOR HIGH STRENGTH WALL AND COVERING ASSEMBLIES, AND METHOD FOR MAKING SAID PANEL

BACKGROUND OF THE INVENTION

The present invention relates to a constructional sandwich panel for high strength wall and covering assemblies, and a method for making said panels.

Vertical dividing panels and horizontal covering panels, for use in the civil, industrial, ship, railroad fields and the like, comprising a pair of plate-like elements coupled in a parallel relationship with one another are already known.

The connection of said plate-like elements is carried out by arranging between the two plate-like elements a further construction element, usually made of an undulated sheet metal material.

This sheet metal material, in particular, has a surface extending through the overall surface of the plate-like elements and has a substantially sinusoidal profile cross-section, i.e. a cross-section profile including a plurality of cascade arranged peak and valley portions.

The sinusoidal surface element is contact engaged with the plate-like element surfaces and is adhesively bound to said surfaces, by using, for example, glue or adhesive materials.

This construction method, while has been found very unexpensive, has, however, the disadvantage that the sinusoidal surface element provides a small contact area for contacting the plate-like elements at each peak and valley of its waved or undulated profile.

This small contact area prevents the thus assembled panel from having a long duration or useful operating life.

Likewise, the provision of curved surfaces contacting the surfaces of the plate-like elements of the panel, causes the assembled panel to have a comparatively poor. mechanical strength.

SUMMARY OF THE INVENTION

Accordingly, the aim of the present invention is to provide a constructional sandwich panel for use in civil, industrial, ship, railroad fields and the like, which has a very high mechanical strength.

According to one aspect of the present invention, the above aim is achieved by the present invention, which provides a very high mechanical strength panel, for vertical dividing and horizontal covering assemblies, as well as for walls for supporting finishing elements, such as marble elements, laminated elements, tiles, fabric coverings, linoleum coverings or the like, said panel comprising at least a plate-like element and being characterized in that it further comprises at least a fretted element glued to said at least a plate-like element.

According to a preferred embodiment of the present invention, the panel comprises two plate-like elements, coupled to one another in a substantially parallel relationship, as well as a fretted element, arranged between said two plate-like elements for connecting said plate-like elements by glueing the parallel surfaces thereof.

The mentioned constructional panel, in particular, can be made with different thicknesses, depending on the construction of the punch element for making the fretted element, and depending on the used materials for forming both the plate-like element and the fretted element.

The present invention further relates to a continuous type of method for making constructional sandwich panels, characterized in that said method comprises a first step for making said fretted element by shaping a sheet metal element by a correspondingly shaped element, and a second operating step in which said plate-like elements and fretted elements are glued to one another.

Said glueing steps, in particular, can be performed by a simple cold stacking operation, or by a hot glueing operation performed in a press type of oven, including two metal sliding belts driven by driving rollers.

BRIEF DESCRIPTION OF THE DRAWINGS

Further advantages and characteristics of the present invention will become more apparent hereinafter from the following detailed disclosure, given by way of an illustrative but not limitative example, with reference to the accompanying drawings, where.

DESCRIPTION OF THE PREFERRED EMBODIMENTS

In the following disclosure reference will be made to some preferred embodiments of the present invention which have been illustrated as a not limitative example of several possible variations of the invention.

Figure 1:
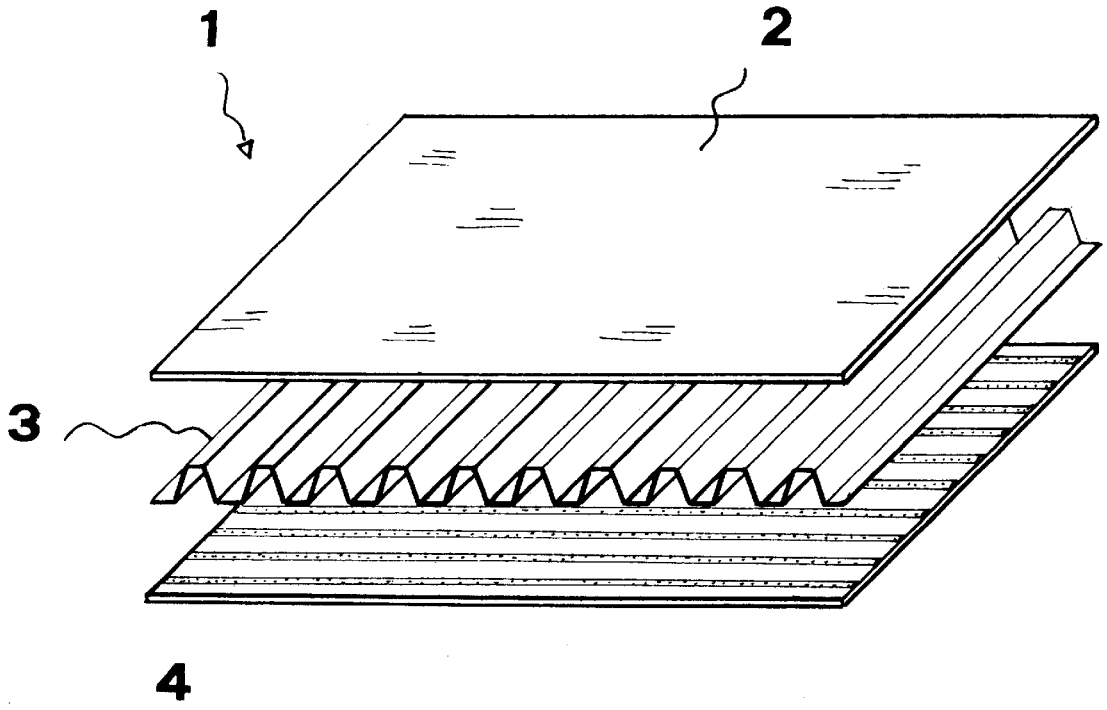
FIG. 1 is an exploded perspective view of a constructional sandwich panel according to the present invention.

FIG. 1, in particular, shows a constructional panel, generally indicated by the reference number 1, comprising a first plate-like element 2 and a second plate-like element 4.

Said plate-like elements can be made of an aluminium material, or of a black or galvanized metal sheet elements, as well as of stainless steel elements, laminated elements or any other suitable alloy element.

Said plate-like elements are coupled to one another with a substantially parallel relationship, a fretted element 3 made of aluminium, black or galvanized sheet metal, stainless steel, laminated materials or alloyed materials being arranged and glued between said plate-like elements.

In this connection it should be pointed out that, for inventive purposes, the term "fretted element" is intended for indicating an element, for example made of a sheet metal material which, through its cross section, presents a profile or contour including a plurality of adjoining trapezium shaped integral elements each provided with a top and a bottom flat horizontal portion, corresponding to peaks and valleys of said profile, and joined by a plurality of portions angled with respect to said horizontal portion, so as to form a series of trapezium patterns. As shown, the fretted element is a p late like sheet element having substantially the same size as said first and second plate elements 2 and 4.

The fretted element 3 is applied, by its horizontal surfaces, to contact the plate-like elements 2 and 4, in order to connect said plate-like elements by glue.

More specifically, the plate-like elements 2 and 4 are glued to the fretted element 3 by a glue which would depend on the elements to be bound.

Figure 2:
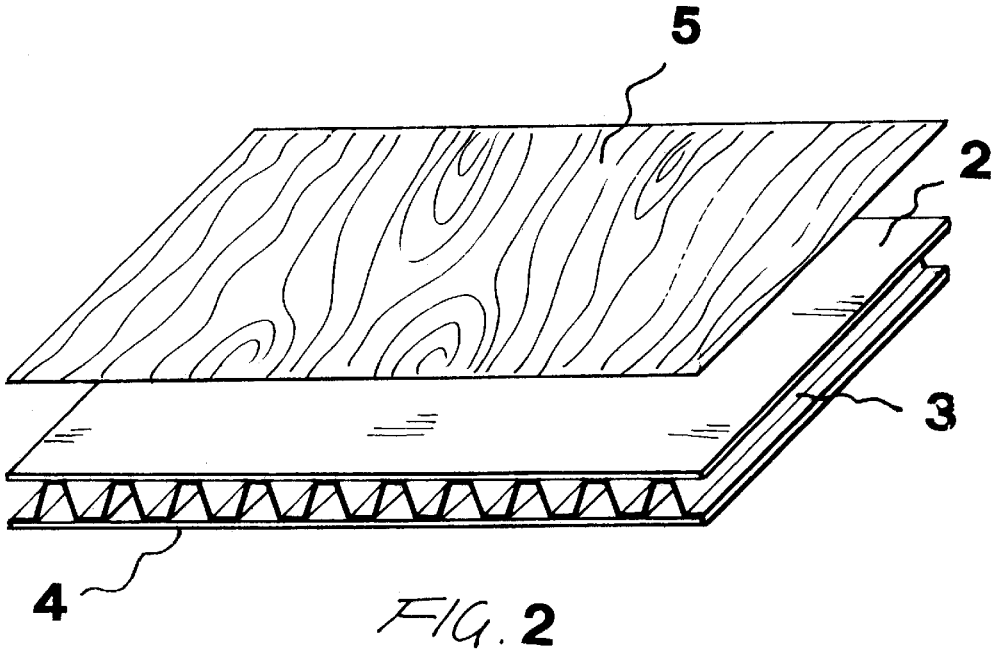
FIG. 2 is another exploded perspective view of the constructional sandwich panel shown in FIG. 1, provided with a finishing melamine laminate coating.

FIG. 2 illustrates a modified embodiment of the present invention, in which the constructional panel 1 is provided moreover with a melamine laminate material plate-like element 5.

Actually, said laminated element can be directly glued to said fretted element, or it can be glued to one of the plate-like elements, depending on the mechanical strength properties to be achieved in the finished panel.

The constructional sandwich panels according to the present invention can also be connected to one another, according to any desired connecting angle, depending on the constructional or finishing requirements to be achieved.

Furthermore, the constructional panels can also be finished by applying on their perimetrical edge portions a profiled element in order to conceal the fretted pattern, to provide a finished flat surface.

Figure 3:
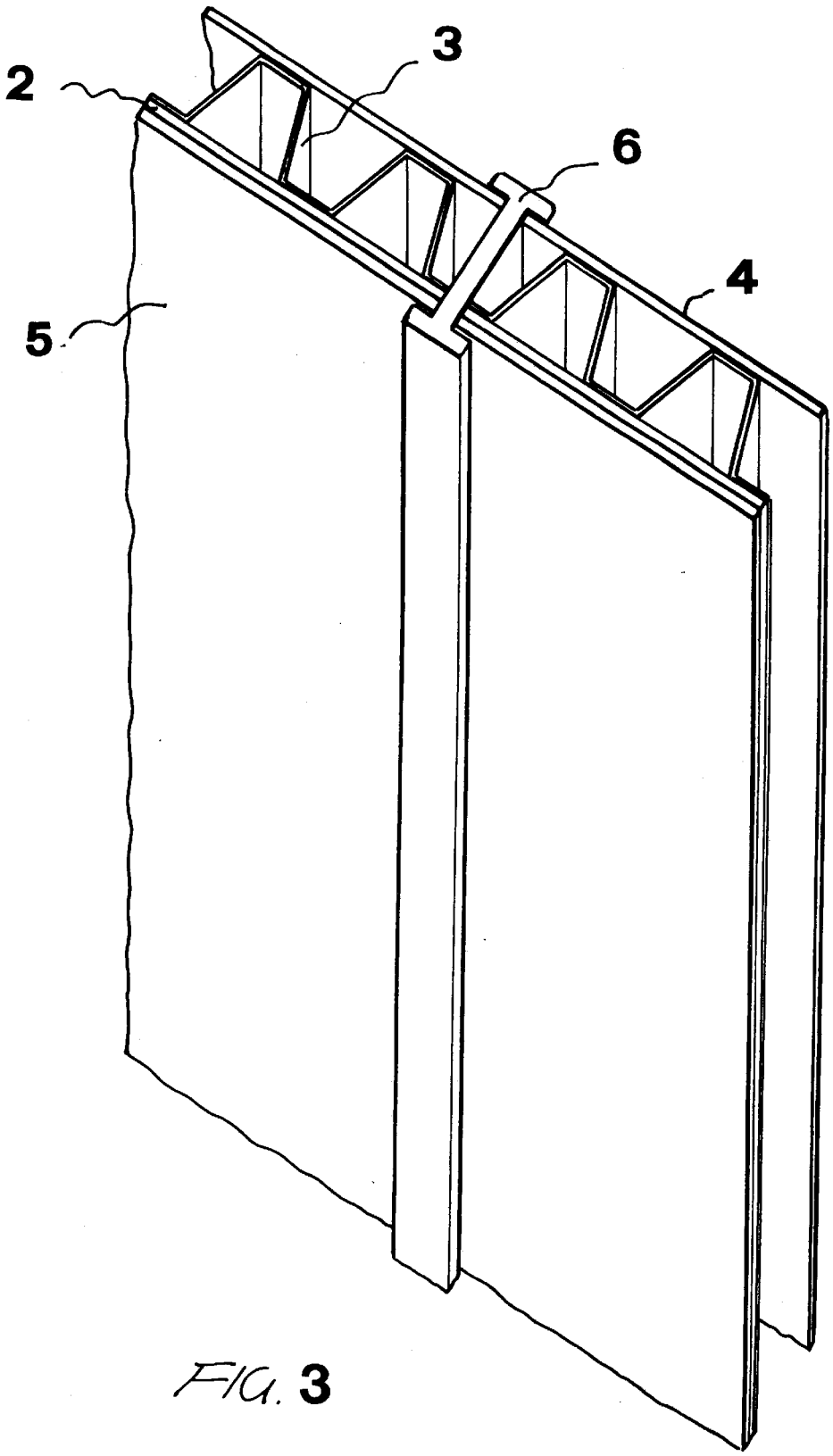
FIG. 3 is a further perspective view of a pair of constructional sandwich panels, coupled to one another along the same connection line, by a tapping profile, which tapping profile can be applied to all of the constructional sandwich panels which will be disclosed hereinafter.
Figure 4:
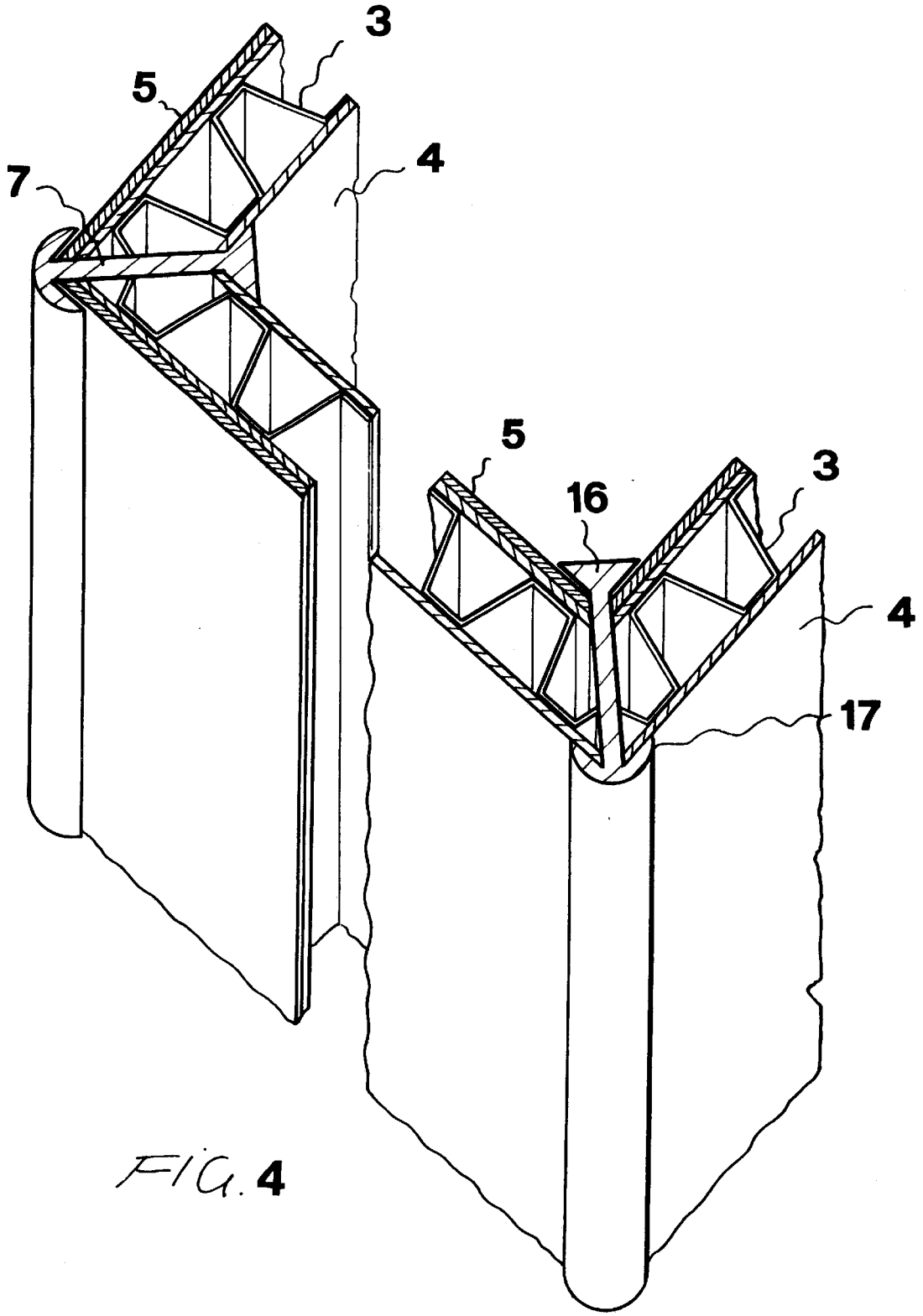
FIG. 4 is a perspective view of two pairs of constructional sandwich panels, right-angle coupled to one another by a second tapping profile, which can be also applied to all of the constructional sandwich panels which will be hereinafter disclosed.

A first type of the mentioned connection patterns of said panels is shown in FIG. 3, where a pair of constructional panels have been connected along the same connecting line by a first profile or section member 6.

A second type of connection for connecting said panels comprises a right angle type of coupling, obtained by using a second profile 7.

In these connections, the laminated element 5, if provided, can be arranged inside the right angle or outside thereof.

The profile 7 is provided with angled portions 16 and 17 allowing panels to be engaged therein for forming the right angle.

A third type of panel connection comprises an obtuse angle panel connection, made by using a third profile 8.

In this connections too, the laminated element 5, if provided, can be arranged inside the obtuse angle or outside thereof.

Figure 6:
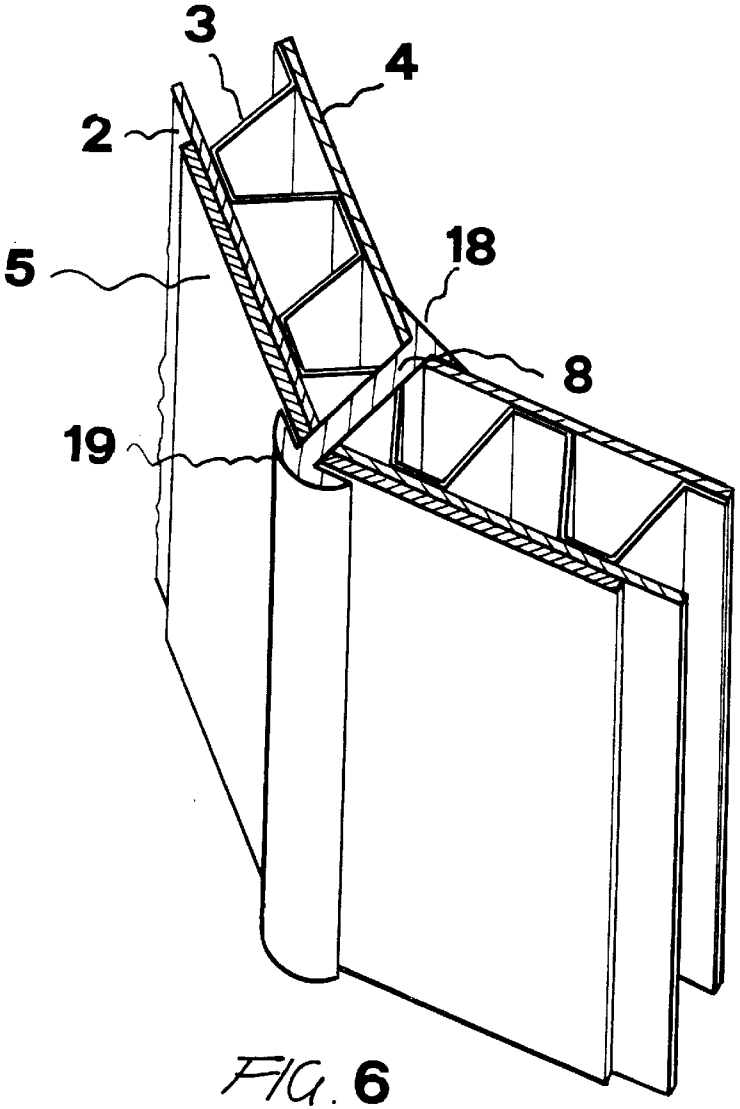
FIG. 6 is a further perspective view of a pair of constructional sandwich panels coupled according to an obtuse angle by a third tapping profile, which can be also applied to all of the constructional sandwich panels hereinafter disclosed.
Figure 5:
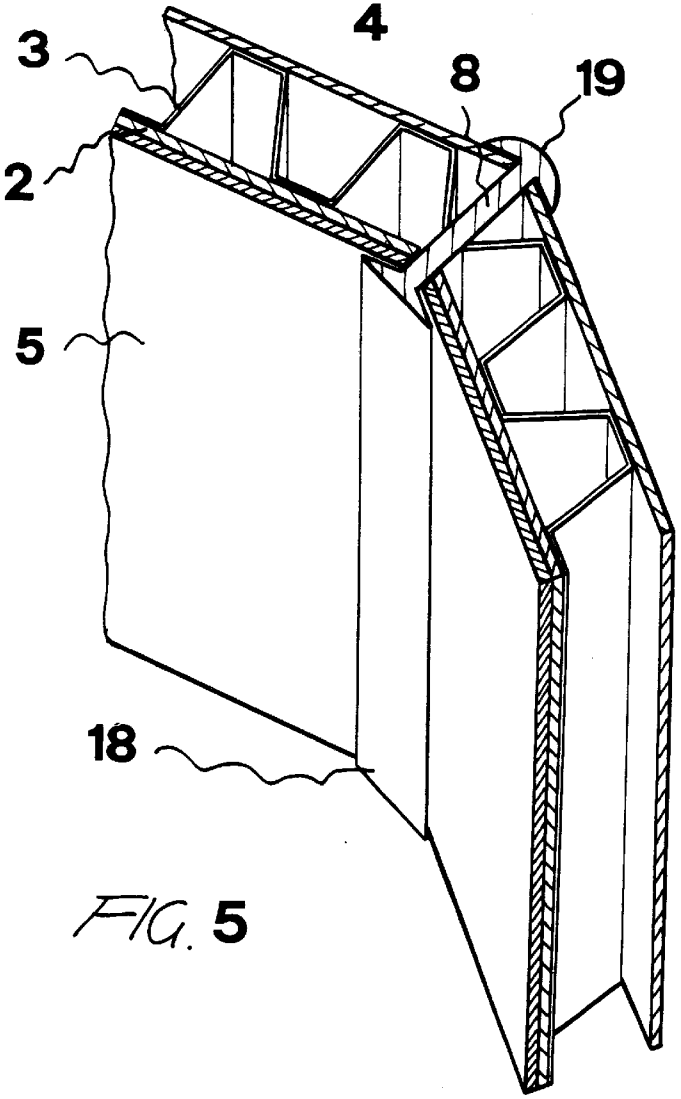
FIG. 5 is a perspective view of a pair of constructional sandwich panels which are obtuse-angle connected to one another by a third tapping profile which can be also applied to all of the constructional sandwich panels hereinafter disclosed.

The profile 8 is provided with angled portions 18 and 19 allowing panels to be engaged therein according to a desired obtuse angle, as shown in FIGS. 5–6.

Figure 7:
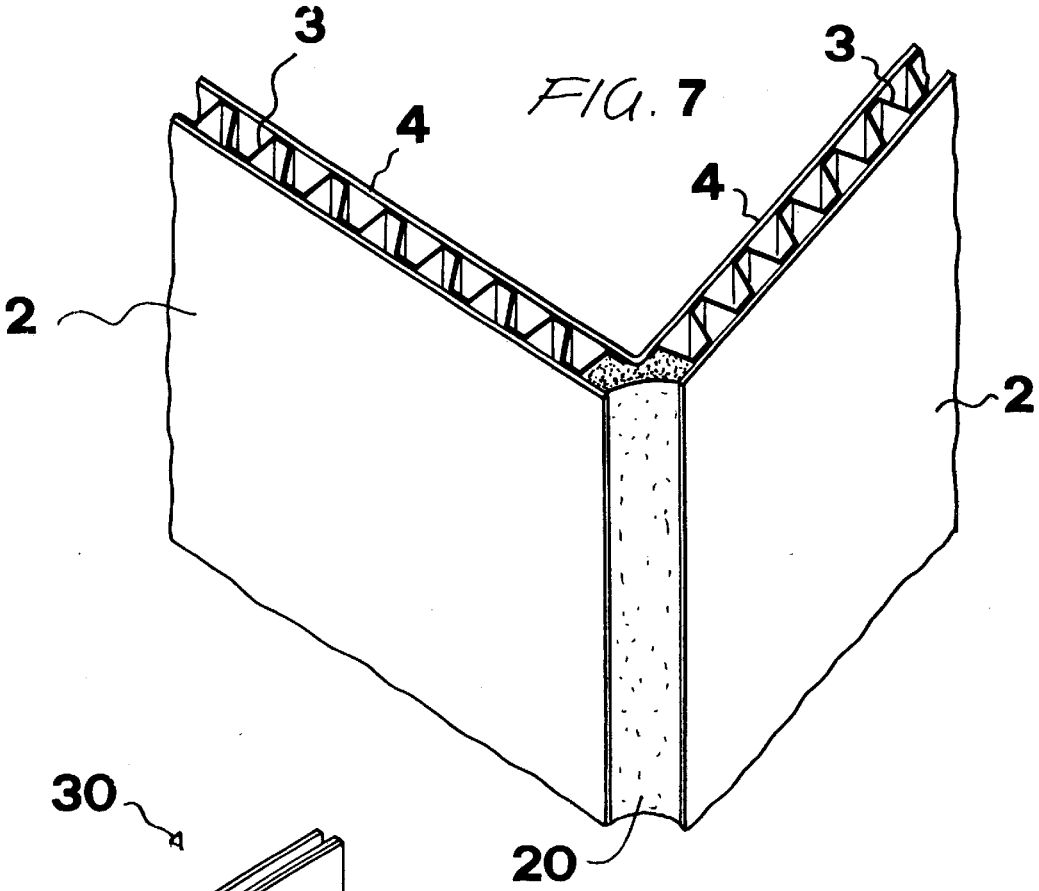
FIG. 7 is a further perspective view of a pair of panels angle connected by a plastic material.

A further connection pattern for angle connecting said panels, provides to use a plastic material 20, to be applied at the outer corner of said angle, so as to mutually connect said panels, upon curing said plastic material, as shown in FIG. 7.

The angle of FIG. 7 (the inner angle exposed to the view) is obtained by vertically cutting the outer plate-like element, and then bending the constructional panel by providing an opening outside of the panel, while assuring the continuity of the inner plate-like element.

Then, a plastic material 20 is applied, which, at the end of the process, will provide the obtained angle with high strength properties.

Figure 16:
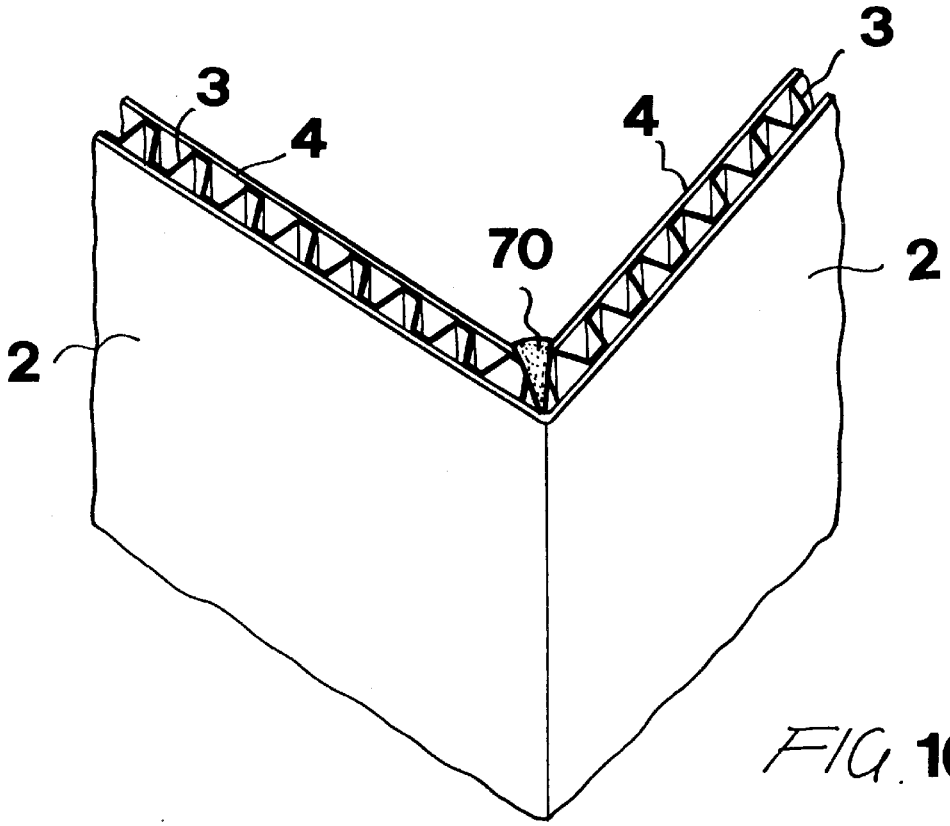
FIG. 16 is a perspective view of a pair of panels angle-connected by using a plastic material on the inside of the connecting angle.

FIG. 16 shows the outer angle obtained by milling the inner plate-like element while holding the continuity of the outer plate-like element, with a subsequent bending and casting of the plastic material 70 in order to provide an angle having the above disclosed features.

Figure 8:
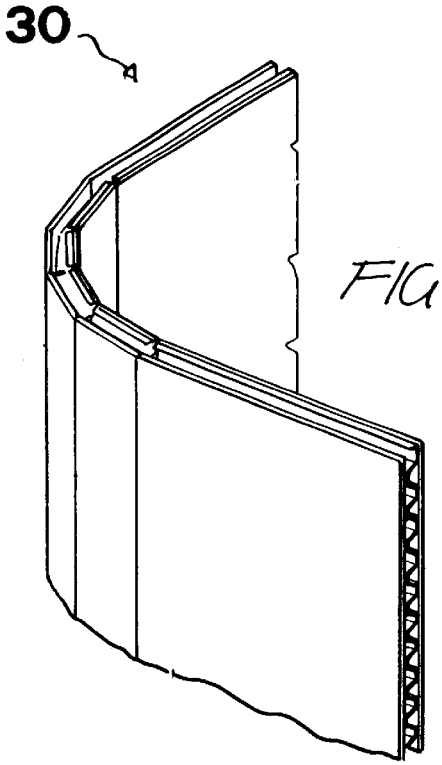
FIG. 8 is a further perspective view of a constructional sandwich panel milled on the inner plate-like thereof in order to provide, by bending, a curve characterized by a continuous outer side.

FIG. 8 illustrates an angled pattern comprising a constructional panel, generally indicated by the reference number 30, which, by milling the inner plate-like element and bending it, but without casting any plastic materials, but merely putting in an adjoining relationship the milled elements, will provide a curved element including an uninterrupted outer plate.

Figure 9:
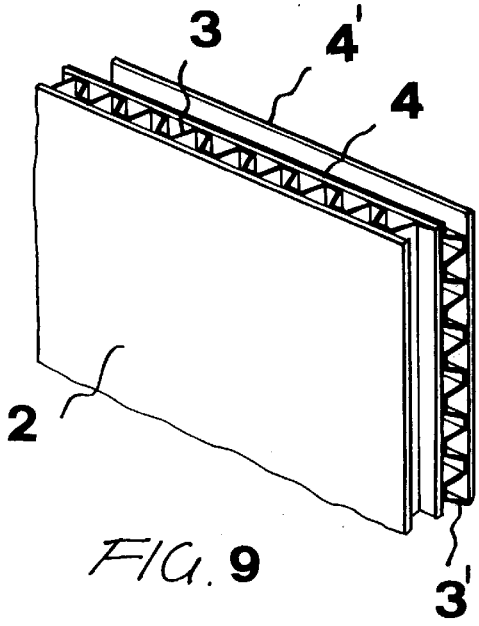
FIG. 9 is a further perspective view of a constructional panel including a further fretted element perpendicular to the first fretted element and a further plate-like element.

FIG. 9 illustrates another embodiment of the constructional panel according to the present invention, which comprises a further fretted element 3' and a further plate-like element 4', to provide the panel with a large thickness and a greater strength.

Figure 17:
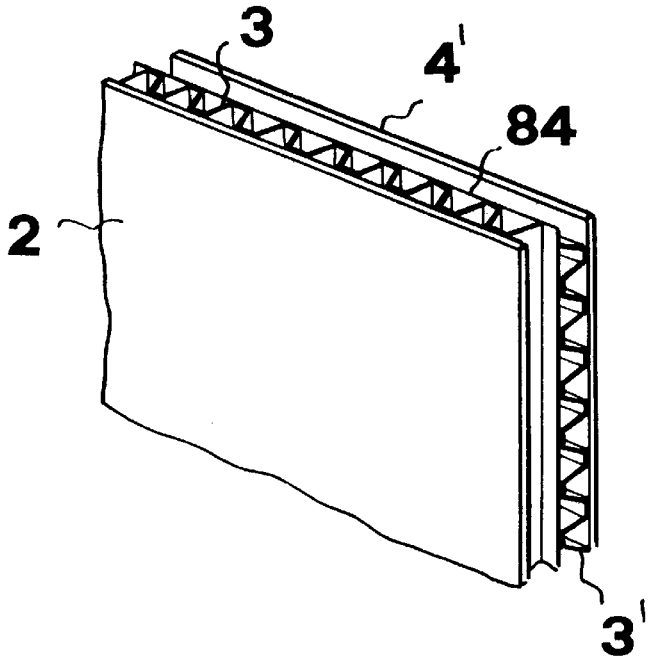
FIG. 17 is a perspective view of a constructional panel including a further fretted element perpendicular to the first fretted element, as well as a further plate-like element.

Likewise, FIG. 17 illustrates another embodiment of the subject constructional panel, including a further fretted element 3', perpendicular to the first fretted element 3, as well as a further plate-like element 4', separated by a plate-like element 84.

Figure 14:
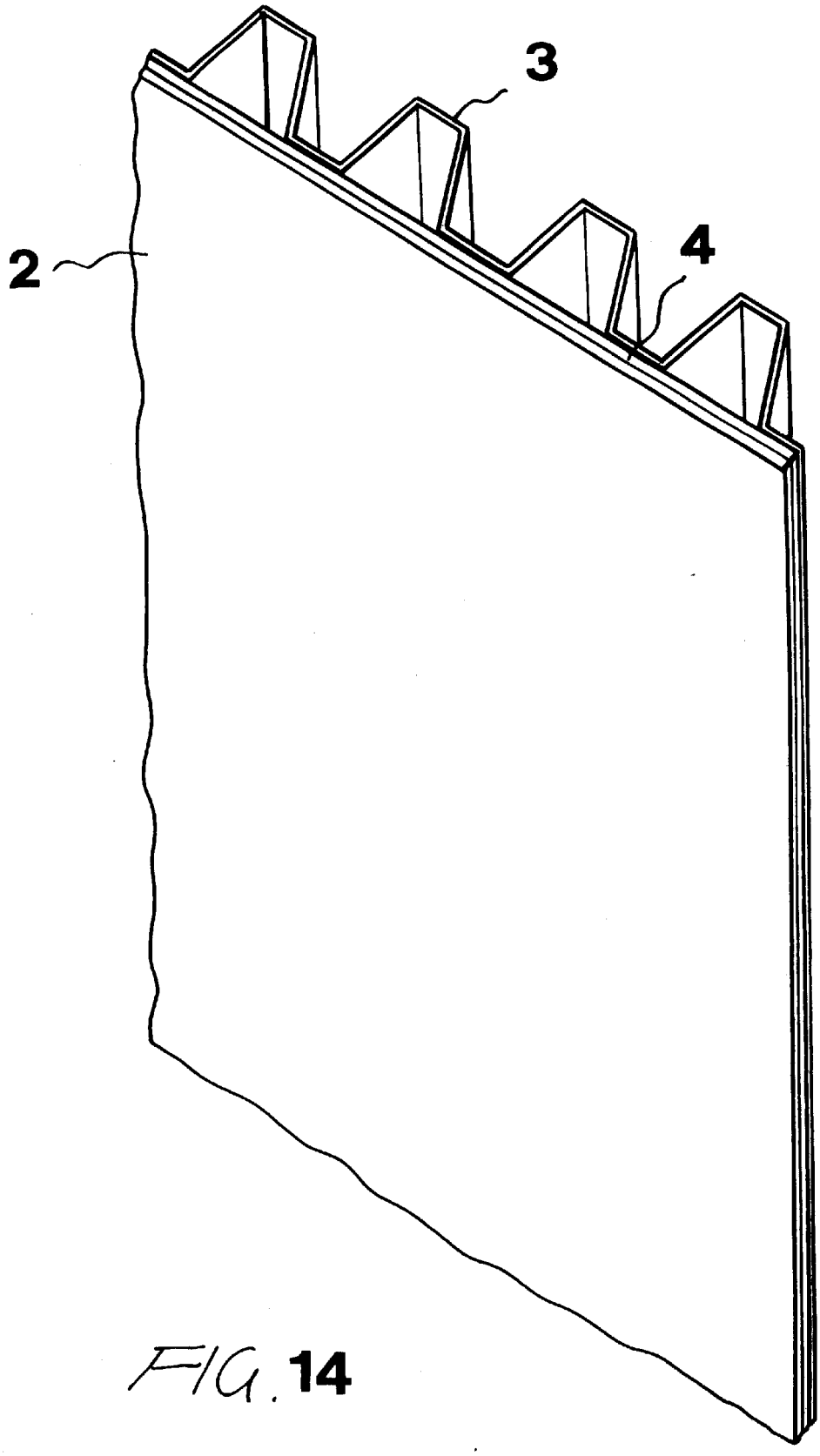
FIG. 14 is a perspective view of a constructional panel having its constructional or structural skin coating only on a side thereof, thereby allowing said panel to be easily curved or bent.

FIG. 14 is a perspective view illustrating a constructional panel having the constructional or structural skin thereof, formed by the plate-like elements 2 and 4, only on a side thereof, so as to allow the panel to be easily bent.

In this case, consequently, the fretted element 3 will be glued to the plate-like element 4.

Figure 15:
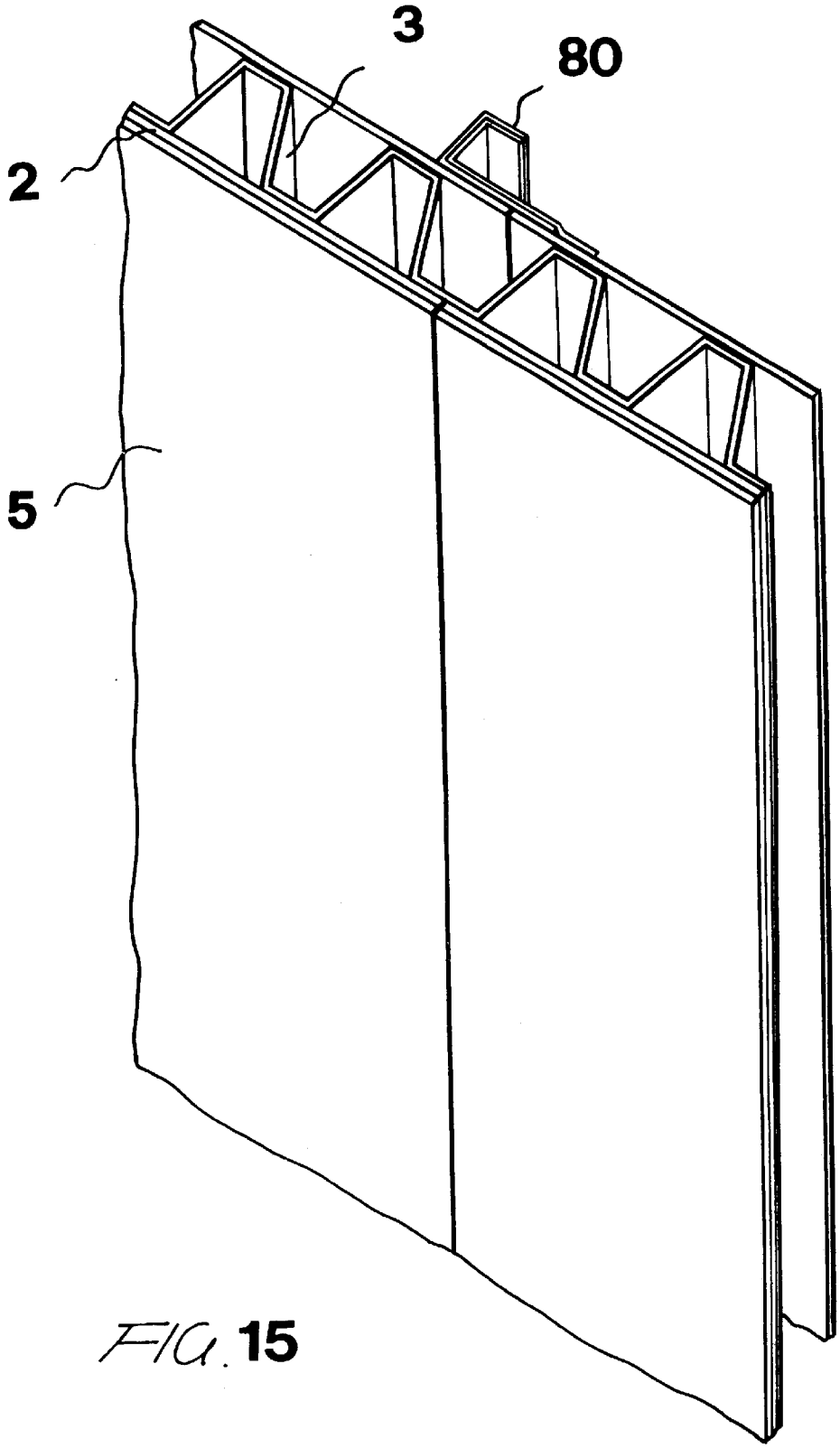
FIG. 15 is a perspective view of a constructional panel therewith an outer bent profile is associated.

FIG. 15 is a perspective view of a constructional panel, according to a preferred embodiment of the invention, to which an outer bent profile 80 has been connected.

Figure 18:
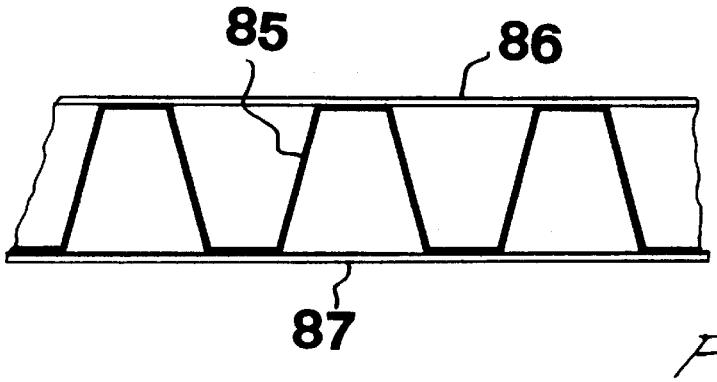
FIG. 18 is a cross-sectional view of a constructional panel having different size flat portions, to allow said panel to be bent according to small bending radii.
Figure 19:
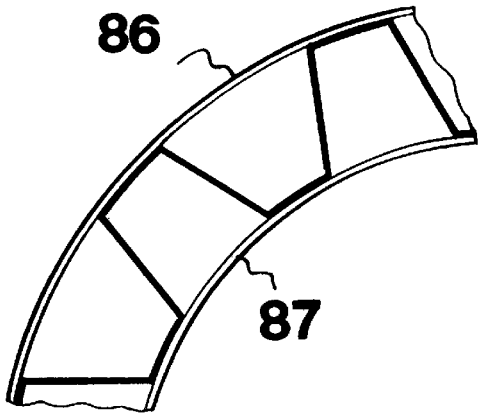
FIG. 19 is a cross-sectional view of a constructional panel bent according to a small bending radius.
Figure 20:
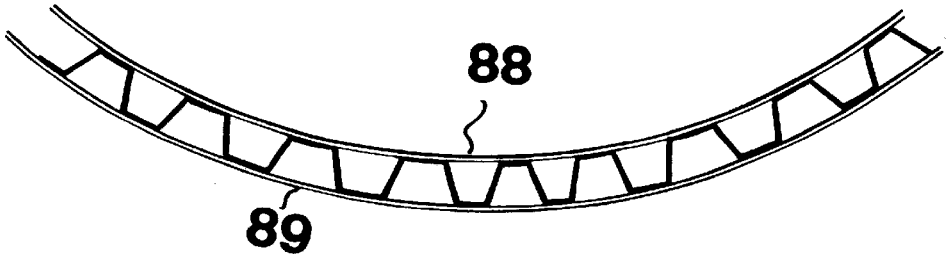
FIG. 20 is a further cross-sectional view of a constructional panel bent according to a large bending radius.

FIG. 18 is a cross-sectional view of a constructional panel including a top plate 86 and a bottom plate 87 and a fretted intermediate element having slanted portions 85 and top flat portions 85' of different sizes having, to allow said panel to be bent according to small bending radii, as clearly shown in FIG. 19 or small bending radii as shown in FIG. 20.

Finally, during the making of the subject constructional sandwich panels, it would be moreover possible to embed profiles or section members, or materials allowing the panel to be used without the need of re-contouring it.

The panel 1 according to the present invention has very long duration properties, since the plate-like elements are glued by exploiting the surfaces of the fretted element parallel to said plate-like elements.

Thus, a very broad glueing surface, and, consequently, a greater stability and life of the panels, will be obtained.

In addition, the provision of flat surfaces contacting the plate-like elements of the panel will provide said panel with very high strength properties.

The present invention also relates to a method for making constructional sandwich panels of the above disclosed type.

The subject method, in particular, comprises a first step of forming the fretted element 3, by beating a sheet metal element by a beating tool 42, having a mated configuration or shape.

Figure 10:
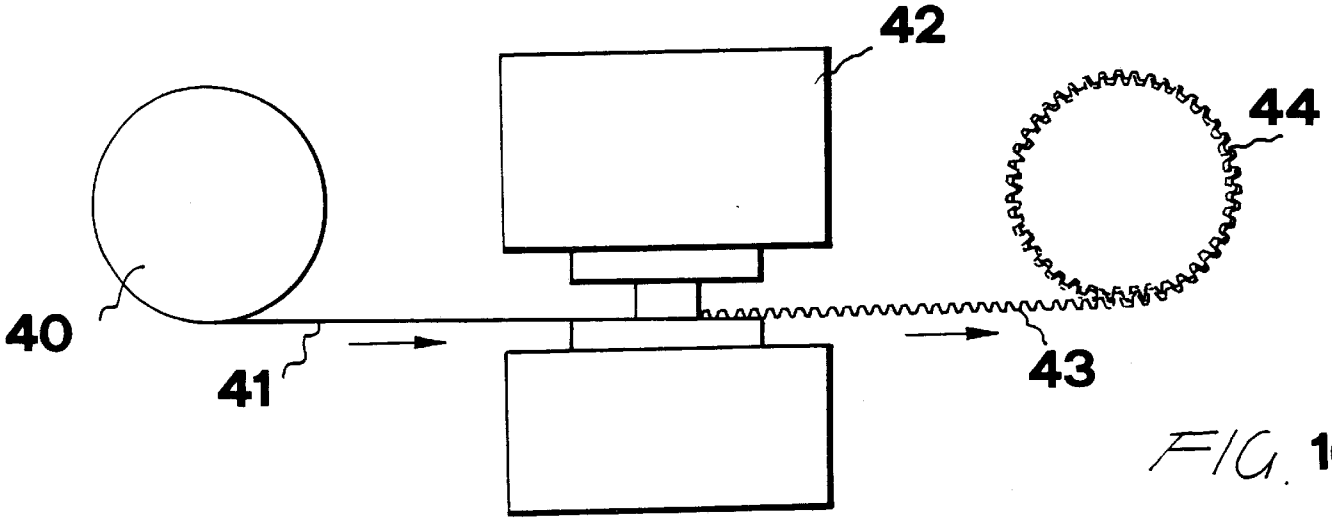
FIG. 10 is a schematic view of an apparatus for carrying out the inventive method for making a panel according to the invention.

In particular, with reference to FIG. 10, the fretted element is unwound from a roll 40 and fed, in a flat form 41, to the tool 42 which will perform a plurality of subsequent beating operations on the flat sheet metal element 41, to deform it according to the fretted contour or profile 43.

Finally, the fretted element is wound on the roll 44.

This method is fully automatized, the aligning and feeding operations included.

In particular, the flat profile 41 is deformed by the beating tool 42, comprising a first element, having a fretted profile portion 50, and a second element, also provided with a fretted profile portion 51, mating, within set tolerances, the mentioned fretted profile portion 50 of the first element.

By using the disclosed beating tool 42, the fretted profile 43 can be easily made by simple beating operations.

The constructional panel according to the present invention can be made with different thicknesses, depending on the beating or punching tool 42.

Figure 11:
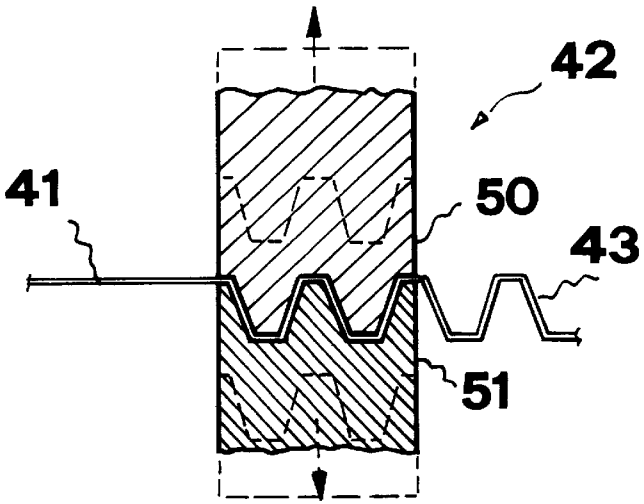
FIG. 11 is a schematic view of a first embodiment of an operating tool used in the panel making method according to the present invention.
Figure 12:
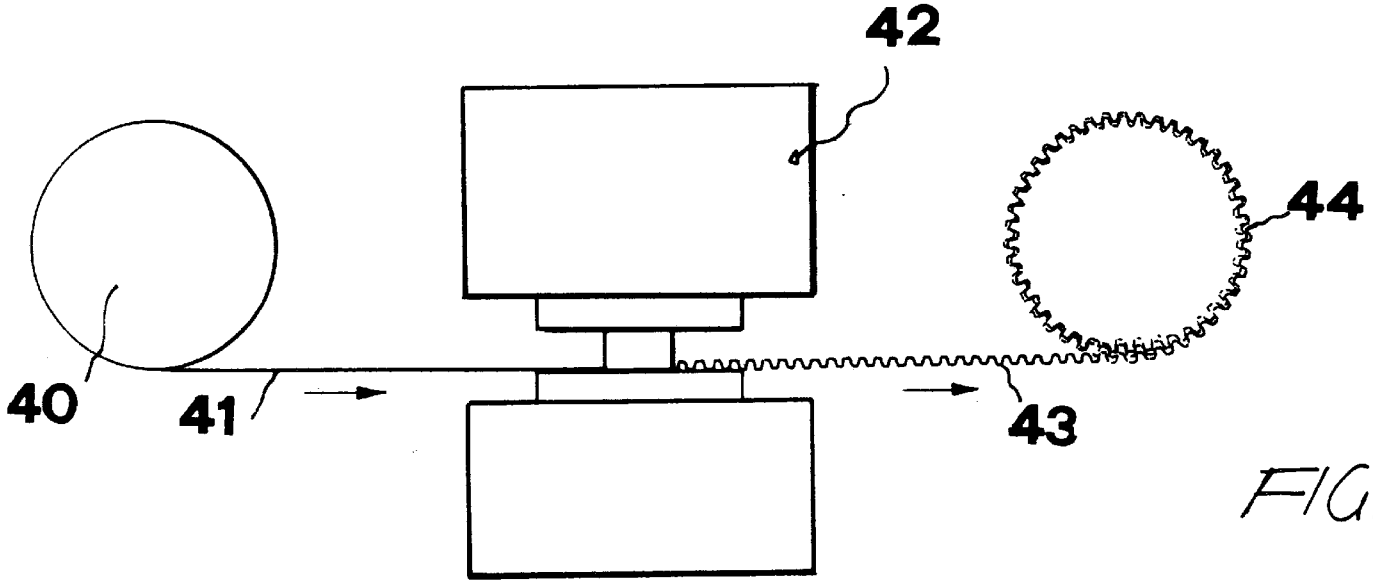
FIGS. 12 and 13 are respective schematic views of the apparatus for carrying out the panel making method of the invention, as well as of a second embodiment of the operating tool used in the inventive method.
Figure 13:
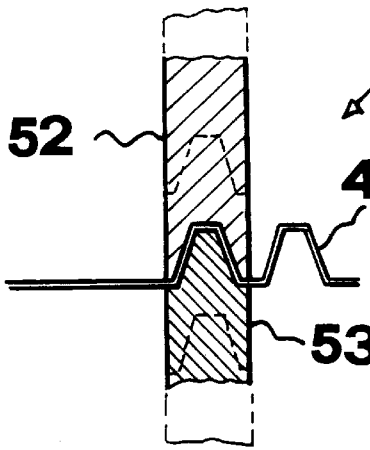

A punching or beating tool having a configuration different from that of the tool shown in FIG. 11 is shown in FIG. 13.

The method comprises, moreover, a second glueing step in which the plate-like elements 2 and 4 are glued on the fretted element 3.

In this connection it should be apparent that the method can be changed depending on the used material or glue; in particular, it can be carried by simple cold pressing operations on a stacked arrangement, whereas, in a second case, it can be carried out by hot glueing and pressing operations performed in a tunnel including two metal belts entrained by driving rollers, as well as a pressing device on the top portion of the tunnel.

The motorized or driven roller belt can be driven in opposite directions.

What is claimed is:

1. A method for making high strength constructional sandwich panels, for high strength wall and covering assemblies, said panel comprising at least a plate element, made of a material selected from the group consisting of aluminum, black steel, galvanized steel, stainless steel and other laminated material elements, coupled to at least a plate fretted member made of a material selected from the group consisting of aluminum, black steel, galvanized steel, stainless steel, laminated materials and alloyed materials, wherein said method comprises the steps of a) supplying a roll of a flat sheet element, b) unwinding from said roll said flat sheet element, c) feeding said flat sheet element in a flat form to a beating tool, said beating tool comprising a top element having a first fretted profile portion and a bottom element having a second fretted profile portion mating said first fretted profile portion, said first and second fretted profile portions including each a plurality of adjoining fretted elements of a trapezoidal profile each said adjoining fretted element having a top flat horizontal portion and a bottom flat horizontal portion, d) driving said beating tool to perform a plurality of beating operations to simultaneously deform said flat sheet plate element to transform said flat sheet plate element into a fretted member having a plurality of adjoining trapezoid shape fretted elements each having a top and a bottom flat portion, e) winding said fretted member into a roll form, said method further comprising an unwinding step of f) unwinding said fretted member from said roll form to provide an extended fretted member and a gluing step g) of coupling by gluing said at least a plate element and said top and bottom flat portions of said fretted elements of said fretted member.

* * * * *